US008657496B2

(12) United States Patent
Takeda et al.

(10) Patent No.: US 8,657,496 B2
(45) Date of Patent: Feb. 25, 2014

(54) PACKAGE BAG AND SPOUT MEMBER

(75) Inventors: Yasuhiro Takeda, Yamato (JP); Kenji Washida, Morioka (JP); Takahiro Koyama, Zama (JP); Junichi Hashimoto, Ebina (JP); Matsutarou Ono, Yokohama (JP); Yasuharu Takada, Tokyo (JP); Toshihiko Mori, Yokohama (JP); Moritoshi Oguni, Tokyo (JP)

(73) Assignees: Morinaga Milk Industry Co., Ltd. (JP); Fujimori Kogyo Co., Ltd. (JP)

( * ) Notice: Subject to any disclaimer, the term of this patent is extended or adjusted under 35 U.S.C. 154(b) by 646 days.

(21) Appl. No.: 12/630,544

(22) Filed: Dec. 3, 2009

(65) Prior Publication Data

US 2010/0086243 A1 Apr. 8, 2010

Related U.S. Application Data

(63) Continuation of application No. PCT/JP2008/060282, filed on Jun. 4, 2009.

(30) Foreign Application Priority Data

Jun. 5, 2007 (JP) ..... P2007-149188

(51) Int. Cl.
*B65D 33/00* (2006.01)
*B65D 65/26* (2006.01)

(52) U.S. Cl.
USPC ..... 383/209; 383/59; 383/200; 383/207; 383/906; 383/61.1; 222/541.6

(58) Field of Classification Search
USPC ..... 383/105, 59, 200, 204, 207–209, 61.1, 383/906; 222/541.5, 541.6
See application file for complete search history.

(56) References Cited

U.S. PATENT DOCUMENTS 3,189,227 A * 6/1965 Hobbs et al. ..... 222/94
4,248,227 A * 2/1981 Thomas ..... 604/200

(Continued)

FOREIGN PATENT DOCUMENTS

DE 60109156 T2 4/2006
JP 5076436 U 10/1993

(Continued)

OTHER PUBLICATIONS

International Preliminary Report on Patentability and Written Opinion of the International Searching Authority; PCT/JP2008/060282; Dec. 7, 2009; 7 pages.

(Continued)

*Primary Examiner* — Jes F Pascua
*Assistant Examiner* — Peter Helvey
(74) *Attorney, Agent, or Firm* — St. Onge Steward Johnston & Reens LLC

(57) ABSTRACT

A spout member including a base portion which is fixed to a bag body, a cylindrical portion which protrudes upward from the base portion, and a sealing portion which seals a front end of the cylindrical portion through a breakable thin portion is disposed between two sheets of film forming the bag body. A sealing chamber accommodating the cylindrical portion and the sealing portion is opened by tearing the two sheets of film along an opening assisting line. An opening assisting plate protruding to at least one of a left side and a right side of the sealing portion is disposed above the opening assisting line. A sandwiching reinforcement seal portion for reinforcing the two sheets of film by sealing inner surfaces thereof is provided between the opening assisting plate and the opening assisting line.

3 Claims, 7 Drawing Sheets

(56) References Cited

U.S. PATENT DOCUMENTS

| | | | | |
|---|---|---|---|---|
| 4,454,979 | A * | 6/1984 | Ikeda et al. | 383/10 |
| 4,797,309 | A * | 1/1989 | Kammerer et al. | 428/35.3 |
| 5,228,782 | A * | 7/1993 | Imer | 383/200 |
| 5,238,157 | A * | 8/1993 | Gentile | 222/541.5 |
| 5,312,189 | A * | 5/1994 | Aeschbach et al. | 383/207 |
| 5,535,885 | A * | 7/1996 | Daniel et al. | 206/484 |
| 5,918,783 | A * | 7/1999 | Kieras et al. | 222/541.6 |
| 5,937,617 | A * | 8/1999 | Yeager | 53/412 |
| 5,957,584 | A * | 9/1999 | Lakey | 383/5 |
| 6,050,451 | A * | 4/2000 | Hess et al. | 222/92 |
| 6,076,664 | A * | 6/2000 | Yeager | 206/217 |
| 6,126,315 | A * | 10/2000 | Ichikawa et al. | 383/43 |
| 6,174,083 | B1 * | 1/2001 | Delefortrie et al. | 383/200 |
| 7,005,150 | B2 * | 2/2006 | Kuge et al. | 426/85 |
| 7,866,886 | B2 * | 1/2011 | Kurosawa et al. | 383/44 |
| 2003/0012851 | A1 * | 1/2003 | Kuge et al. | 426/85 |
| 2003/0127472 | A1 | 7/2003 | Doherty et al. | |
| 2009/0097779 | A1 * | 4/2009 | Branch | 383/5 |

FOREIGN PATENT DOCUMENTS

| | | | |
|---|---|---|---|
| JP | 10305850 | A | 11/1998 |
| JP | 3061374 | U | 6/1999 |
| JP | 3061374 | U | 9/1999 |
| JP | 11263354 | A | 9/1999 |
| JP | 11263355 | A | 9/1999 |
| JP | 2003535773 | T | 12/2003 |
| WO | 0194213 | A2 | 12/2001 |

OTHER PUBLICATIONS

International Search Report; PCT/JP2008/060282; Aug. 13, 2008; 4 pages.

* cited by examiner

PACKAGE BAG AND SPOUT MEMBER

CROSS-REFERENCE TO RELATED APPLICATIONS

The present application is a continuation of pending International patent application PCT/JP2008/060282 filed on Jun. 4, 2009 which designates the United States and claims priority from Japanese Patent Application No. P2007-149188, filed Jun. 5, 2007, the content of which is incorporated herein by reference.

FIELD OF THE INVENTION

The present invention relates to a package bag in which a spout member is sealed between films and a spout member which is suitably used for the package bag.

BACKGROUND OF THE INVENTION

In order to easily extract contents from a package bag, a package bag attached with a spout member has been used in which an upper portion of a package bag is provided with a spout member. When the spout member is exposed to the outside of the package bag, the spout member may be contaminated by external air, dust, or the like. For this reason, there is known a package bag in which a spout member is sealed between films (see Japanese Unexamined Patent Application, First Publication No. H10-305850 ("Patent Document 1")). In the case of the package bag attached with the spout disclosed in the Patent Document, in order to extract the contents, first, the package bag is torn so as to expose the spout to the outside, and then a thin portion of the spout is broken by a finger so as to open the spout (see the paragraph "0024" of Patent Document 1).

SUMMARY OF THE INVENTION

If the spout needs to be opened by touching the spout member with one's hand, dirt on the bag may be moved to the finger or dirt on the finger may be moved to the bag upon opening the bag. Therefore, the spout needs to be opened while carefully watching the dirt on the surface of the bag. For this reason, it has been demanded that a series of operations of opening the bag and opening the spout are promptly performed.

The present invention is contrived in consideration of the above-described circumstance, and an object of the present invention is to provide a package bag in which a spout member is sealed between films forming a package bag and a series of operations of opening a bag and opening a spout can be promptly performed.

In order to achieve the above-described object, the present invention provides a package bag including: two sheets of film which form a bag body; and a spout member which is formed between the two sheets of film, wherein the spout member includes a base portion which is fixed to the bag body, a cylindrical portion which protrudes upward from the base portion, and a sealing portion which seals a front end of the cylindrical portion through a breakable thin portion, the base portion is fixed to the two sheets of film through a first seal portion formed by sealing inner surfaces of the two sheets of film to an outer surface of the base portion, the cylindrical portion and the sealing portion are accommodated in a sealing chamber while being sandwiched between the two sheets of film, the sealing chamber is surrounded by the first seal portion and a second seal portion formed by sealing the inner surfaces of the two sheets of film to each other in the vicinity of the cylindrical portion and the sealing portion, the sealing chamber is opened by tearing the two sheets of film along an opening assisting line having both ends located inside the second seal portion and opened along the first seal portion, and an opening assisting plate protruding to at least one of a left side and a right side of the sealing portion is provided above the opening assisting line, and sandwiching reinforcement seal portions for reinforcing the two sheets of film by sealing the inner surfaces thereof are provided between the opening assisting plate and the opening assisting line.

In the package bag according to the present invention, the opening assisting plates respectively protruding to both left and right sides of the sealing portion of the spout member may be provided above the opening assisting line; the sandwiching reinforcement seal portions formed in left and right sides of the spout member may be provided between the opening assisting plates and the opening assisting line; and a gap between the left and right sandwiching reinforcement seal portions may be shorter than a transverse width of the opening assisting plates.

In the package bag according to the present invention, part of the sealing chamber may be opened along the first seal portion, the opening assisting plates may be twisted so as to break the thin portion and to open the cylindrical portion in the state where the sealing portion of the spout member is sandwiched between the two sheets of film, and then a remaining portion of the two sheets of film may be torn so as to be separated from the bag body in a state where the sealing portion is sandwiched between the two sheets of film.

Further, the present invention provides a spout member including: a base portion which is fixed to a bag body; a cylindrical portion which protrudes upward from the base portion; and a sealing portion which seals a front end of the cylindrical portion through a breakable thin portion, wherein the sealing portion is provided with the opening assisting plate which is formed in a plate shape and obliquely swollen downward.

The opening assisting plates may be formed so as to be symmetric to each other in the transverse direction with respect to the cylindrical portion serving as a symmetric axis.

The opening assisting plates may be connected to the cylindrical portion through the breakable thin portion.

The cylindrical portion may include an annular convex portion which is formed on an outer surface thereof so as to lock a tube onto the cylindrical portion.

According to the package bag of the present invention, since it is possible to easily open the spout member sealed between the films without directly touching the spout member, the package bag is hygienic. Further, since the opening assisting plates are caught by the sandwiching reinforcement seal portions upon removing a portion of the film sandwiching the spout member after opening the package bag, it is possible to prevent the sealing portion of the spout member from falling off.

According to the spout member of the present invention, even when the spout member is sealed between the films, it is possible to easily open the spout member without directly touching the spout member.

DETAILED DESCRIPTION OF THE INVENTION

Hereinafter, a preferred embodiment of the present invention will be described with reference to the drawings.

Figure 1:
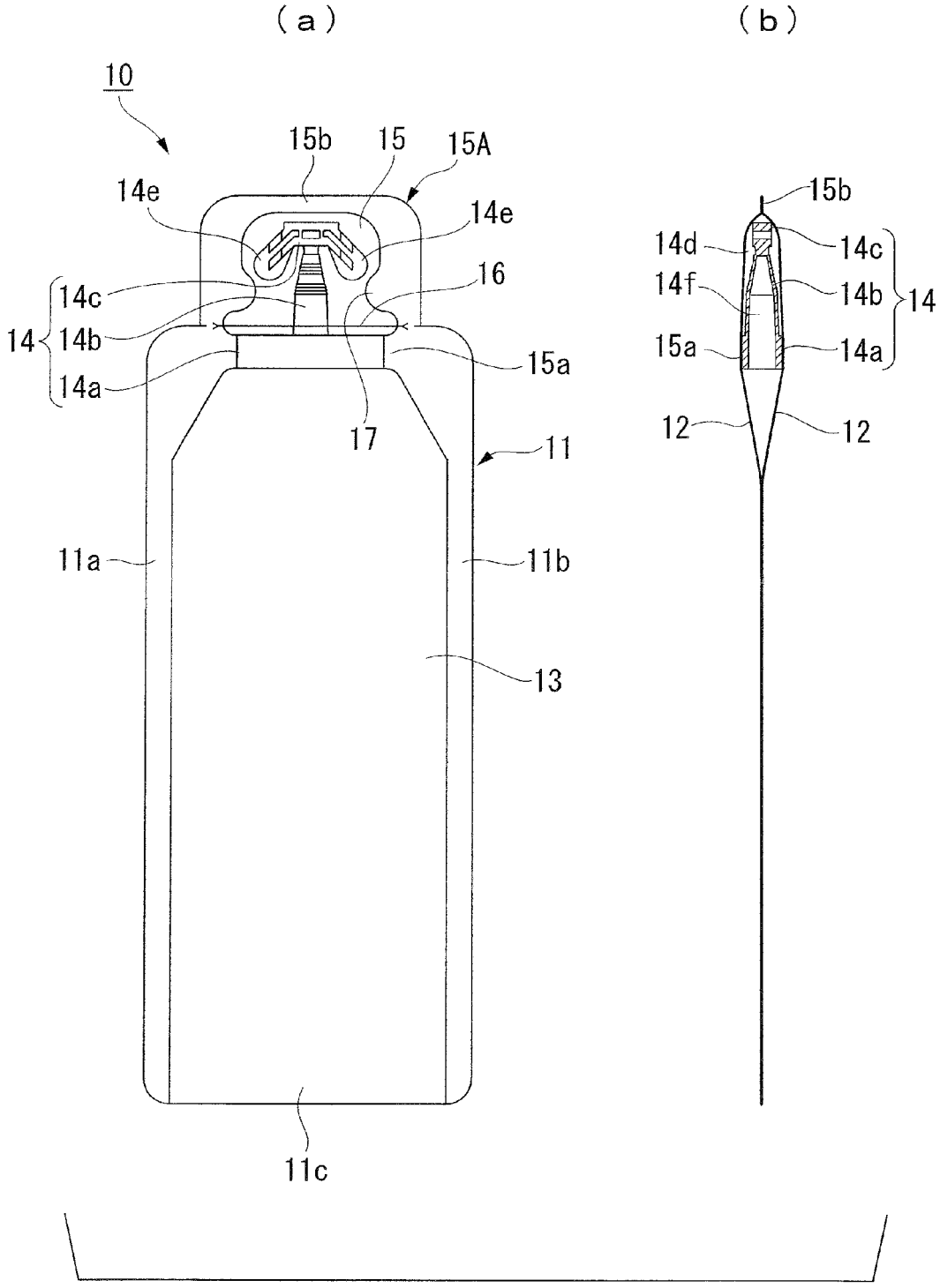
FIG. 1 is a view showing an example of a package bag according to the present invention where (a) of FIG. 1 is a front view thereof and (b) of FIG. 1 is a central longitudinal sectional view thereof.
Figure 2:
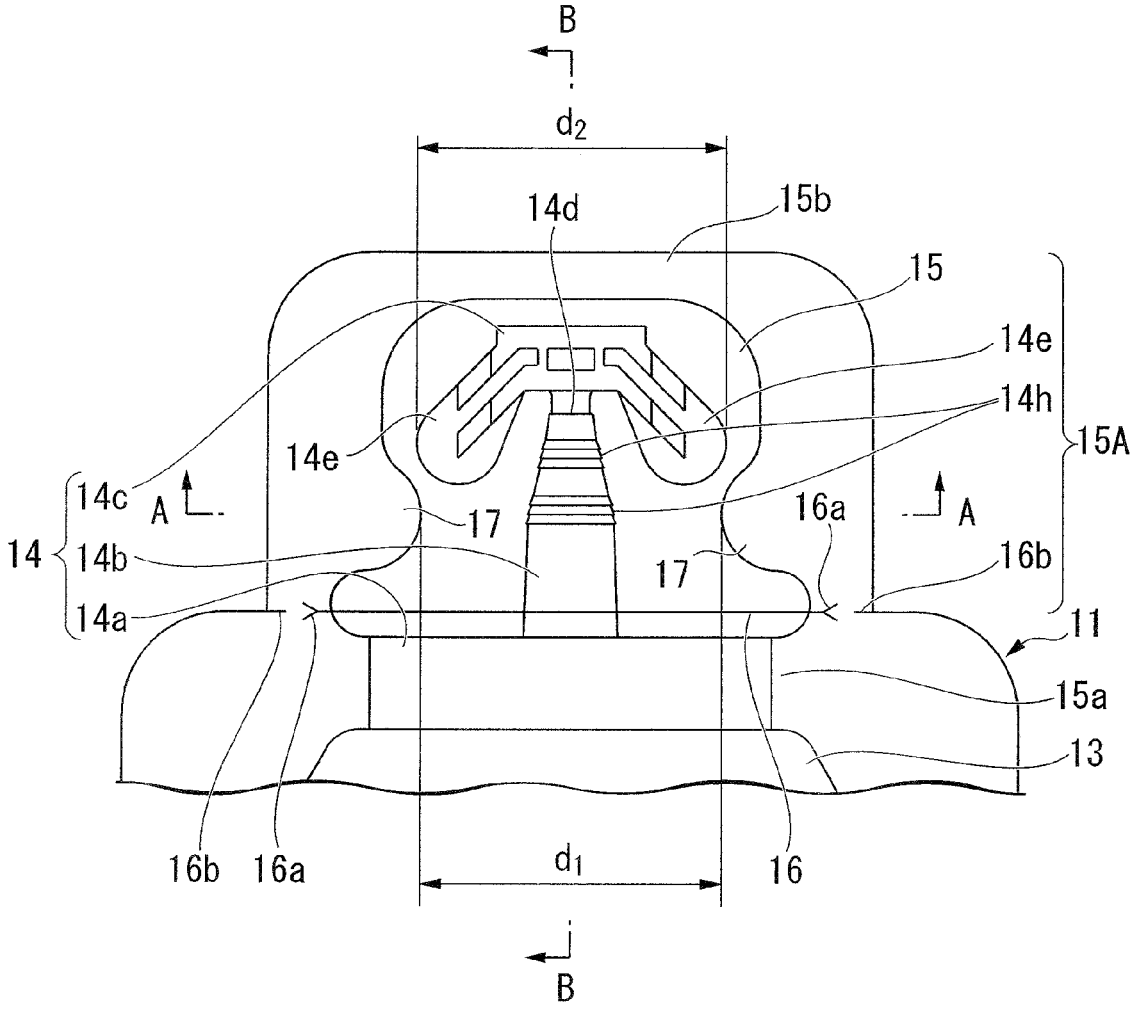
FIG. 2 is an enlarged front view showing a main part of the package bag shown in FIG. 1.
Figure 3:
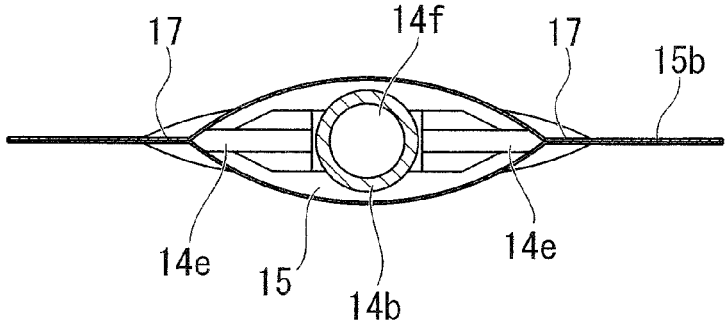
FIG. 3 is a sectional view taken along the line A-A in FIG. 2.
Figure 4:
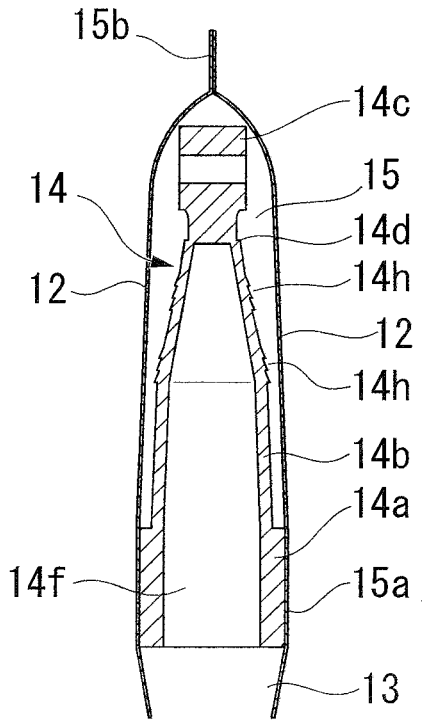
FIG. 4 is a sectional view taken along the line B-B in FIG. 2.
Figure 5:
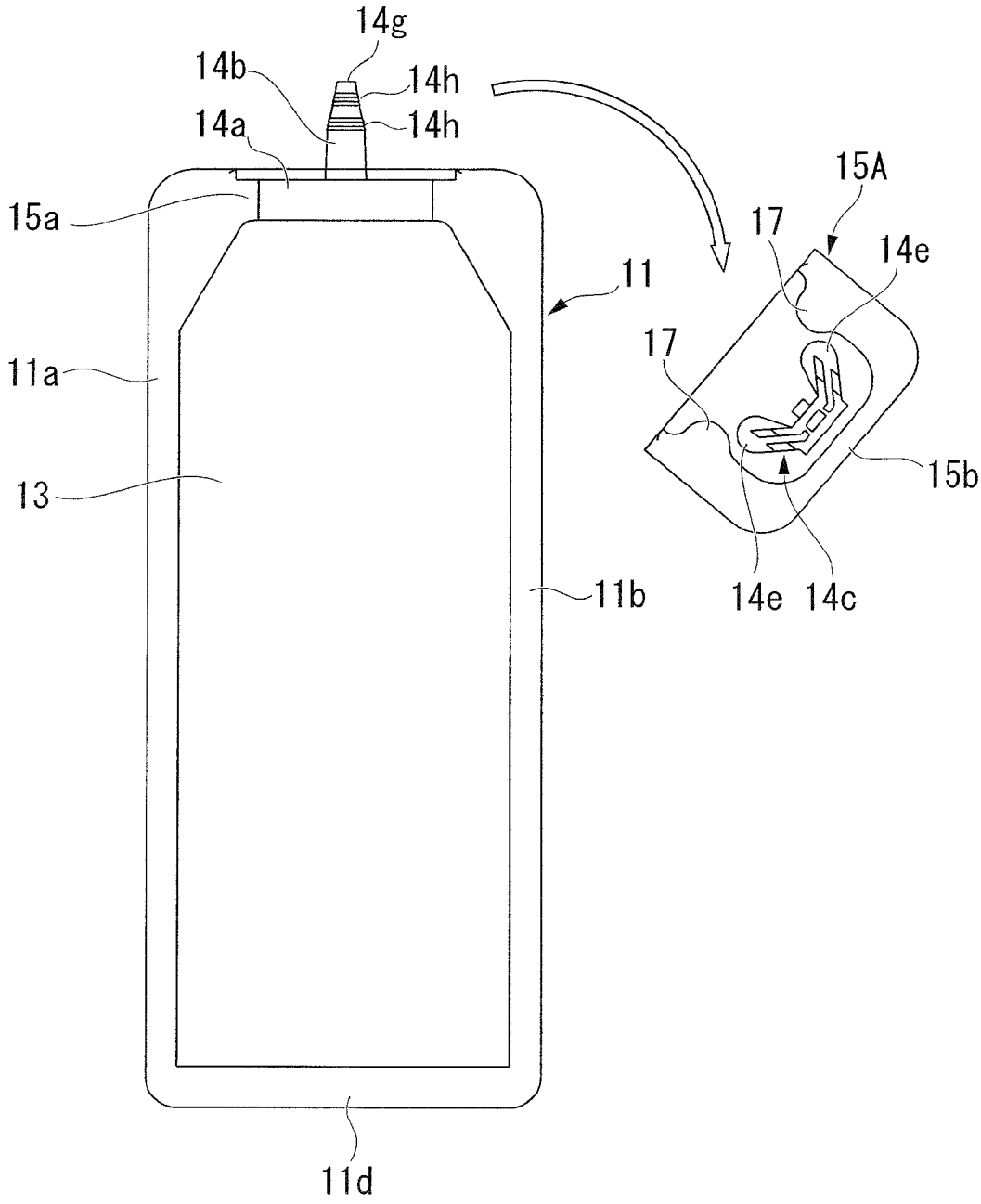
FIG. 5 is a front view showing a state where the package bag shown in FIG. 1 is opened.

FIGS. 1 to 5 are views showing an example of a package bag according to the present invention, where (a) of FIG. 1 is a front view thereof; (b) of FIG. 1 is a central longitudinal sectional view thereof; FIG. 2 is an enlarged front view showing a main part thereof; FIG. 3 is a sectional view taken along the line A-A in FIG. 2; FIG. 4 is a sectional view taken along the line B-B in FIG. 2; and FIG. 5 is a front view showing an opened state thereof.

As shown in FIG. 1, a package bag 10 according to this example is obtained by sealing a spout member 14 in the inside of a bag body 11 formed by a film. In the case of this example, the bag body 11 is a planar bag formed by two sheets of body films 12 and 12 having the same planar shape. Both edge portions of the bag body 11 are provided with side edge sealing portions 11*a* and 11*b*, and the lower portion of the bag body 11 is not sealed so that a filling opening 11*c* is opened therefrom. The filling opening 11*c* can be sealed in such a manner that contents are filled into an accommodation chamber 13 and the body films 12 and 12 are sealed to each other so as to form a bottom sealing portion 11*d* (see FIG. 5). In addition, although it is not particularly shown in the drawings, a standing pouch may be formed by disposing a bottom film at the lower portion of the bag body 11.

In addition, when a non-sealed portion which is 1 to 2 mm is formed in the outer edge portion of the bag body 11 of the side edge sealing portions 11*a* and 11*b*, the side edge portion of the bag body are flexible, which is suitable in that a person's fingers or the like are not hurt when the contents are extracted by using their bare hands.

As the film forming the bag body 11, a material having been used from the past may be used. For example, a film formed of biaxially-stretched polypropylene, biaxially-stretched polyamide, biaxially-stretched polyester, or the like may be used as a base film, and a polyolefin-based resin such as low-density polyethylene, linear low-density polyethylene, ethylene-vinyl acetate copolymer, or polypropylene may be laminated as a sealant layer on the base film so as to form a laminated structure. As a method of manufacturing a laminated film, dry-laminating, extrusion-laminating, or co-extruding or the like may be used. In order to improve the adhesive strength, an adhesive agent or an anchor agent may be disposed between the base film layer and the sealant layer. In this case, in order to improve the strength of the package bag, a plurality of base films may be laminated. Alternatively, in order to improve the barrier properties for gas, ultraviolet rays, or vapor, a metallic foil such as an aluminum foil, a metal deposition layer, an inorganic deposition layer such as ceramic, or ethylene-vinyl alcohol copolymer film may be laminated.

In order to improve the easy-tear properties of the bag body 11 in the horizontal direction, when an uniaxially-stretched film such as polyolefin or nylon is used or an easy-tear nylon film obtained by stretching a resin film mixed with aromatic nylon such as 6 nylon or MXD 6 is used, it is desirable in that it be possible to tear the bag body at an arbitrary position thereof in a linear shape and to exhibit the easy-tear properties.

In addition, as means for ensuring the easy-tear properties in the horizontal direction, other layers such as a sealant layer may be laminated on the base film after forming a perforation in the base film, or a half cut groove may be formed on the surface of the body film by means of a laser beam or the like.

The dimension of the bag body 11 is not particularly limited. For example, the height of the bag body may be set to around 100 to 500 mm, the width thereof may be set to around 70 to 300 mm, and the filling amount of the contents may be set to be equal to around 100 to 5,000 g.

A spout member 14 includes at least a base portion 14*a* which is fixed to the bag body 11, a cylindrical portion 14*b* which protrudes upward from the base portion 14*a*, and a sealing portion 14*c* which seals the front end of the cylindrical portion 14*b* through a breakable thin portion 14*d*. The spout member 14 is disposed between two sheets of body films 12 and 12, and the base portion 14*a* is fixed to a body film 12 through a first seal portion 15*a* which is formed by sealing the inner surface of the body film 12 to the outer surface of the base portion 14*a*. In addition, a second seal portion 15*b*, formed by sealing the inner surfaces of the body film 12 to each other, is disposed in the vicinity of the cylindrical portion 14*b* and the sealing portion 14*c* of the spout member 14, and the cylindrical portion 14*b* and the sealing portion 14*c* are accommodated in a sealing chamber 15 which is surrounded by the second seal portion 15*b* and the first seal portion 15*a*. In the bag body 11, a portion lower than the first seal portion 15*a* is formed as the accommodation chamber 13 which accommodates the contents and the sealing chamber 15 is separated from the accommodation chamber 13 by the first seal portion 15*a*.

As shown in FIGS. 2 and 3, the sealing portion 14*c* of the spout member 14 is provided with a pair of opening assisting plates 14*e* and 14*e* which protrudes to both sides in the transverse direction. In this example, the opening assisting plate 14*e* is formed as a plate-shaped member which is obliquely swollen downward from the portion sealing the front end of the cylindrical portion 14*b* of the sealing portion 14*c*, and the opening assisting plate 14*e* is formed from the front end of the cylindrical portion 14*b* toward the base portion 14*a*. In addition, the opening assisting plates 14*e* are formed so as to be symmetric to each other with respect to the cylindrical portion 14*b* serving as the symmetric axis. For this reason, it is possible to open the opening assisting plates from any side in the transverse direction in the same manner, and it is not necessary to select the opening direction.

Figure 8:
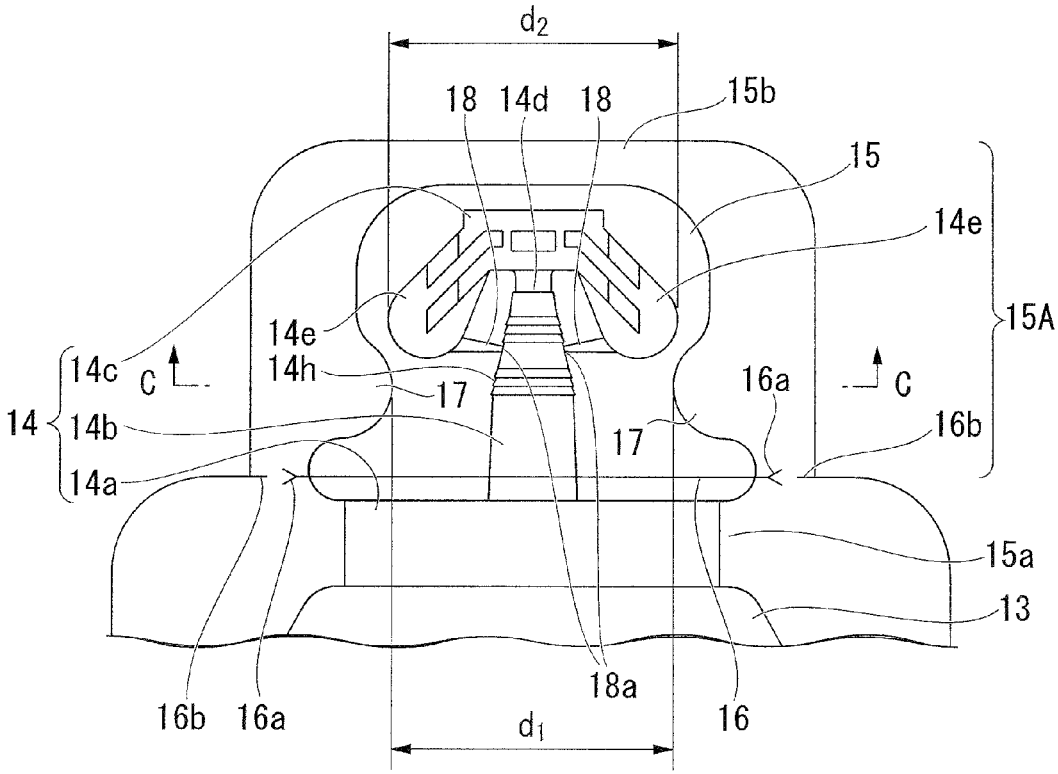
FIG. 8 is an enlarged front view showing a main part of the package bag according to a modified example of the present invention.
Figure 9:
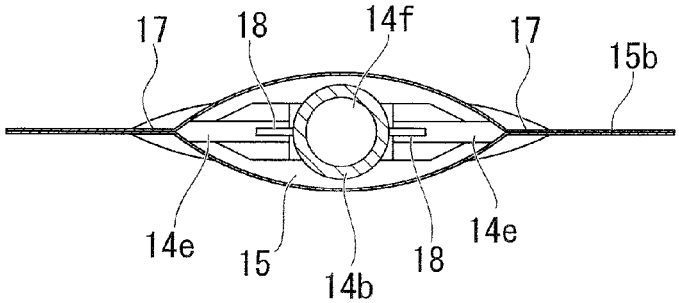
FIG. 9 is a sectional view taken along the line C-C in FIG. 8.

Further, in the present invention, as shown in FIGS. 8 and 9, when the opening assisting plates 14*e* and 14*e* are provided with reinforcement connection pieces 18 for connecting the opening assisting plates 14*e* and 14*e* to the cylindrical portion 14*b* through the thin portion 18*a*, which is breakable from the cylindrical portion 14*b*, it is suitable in that an unintended opening operation is prevented.

In the present invention, the opening assisting plate 14*e* may be formed so as to protrude from at least any one of the left and right sides of the sealing portion 14*c*. In this case, a sandwiching reinforcement seal portion 17 to be described later may be formed in any one of the left and right sides of the cylindrical portion 14*b* so long as the opening assisting plate 14*e* is formed.

Figure 10:
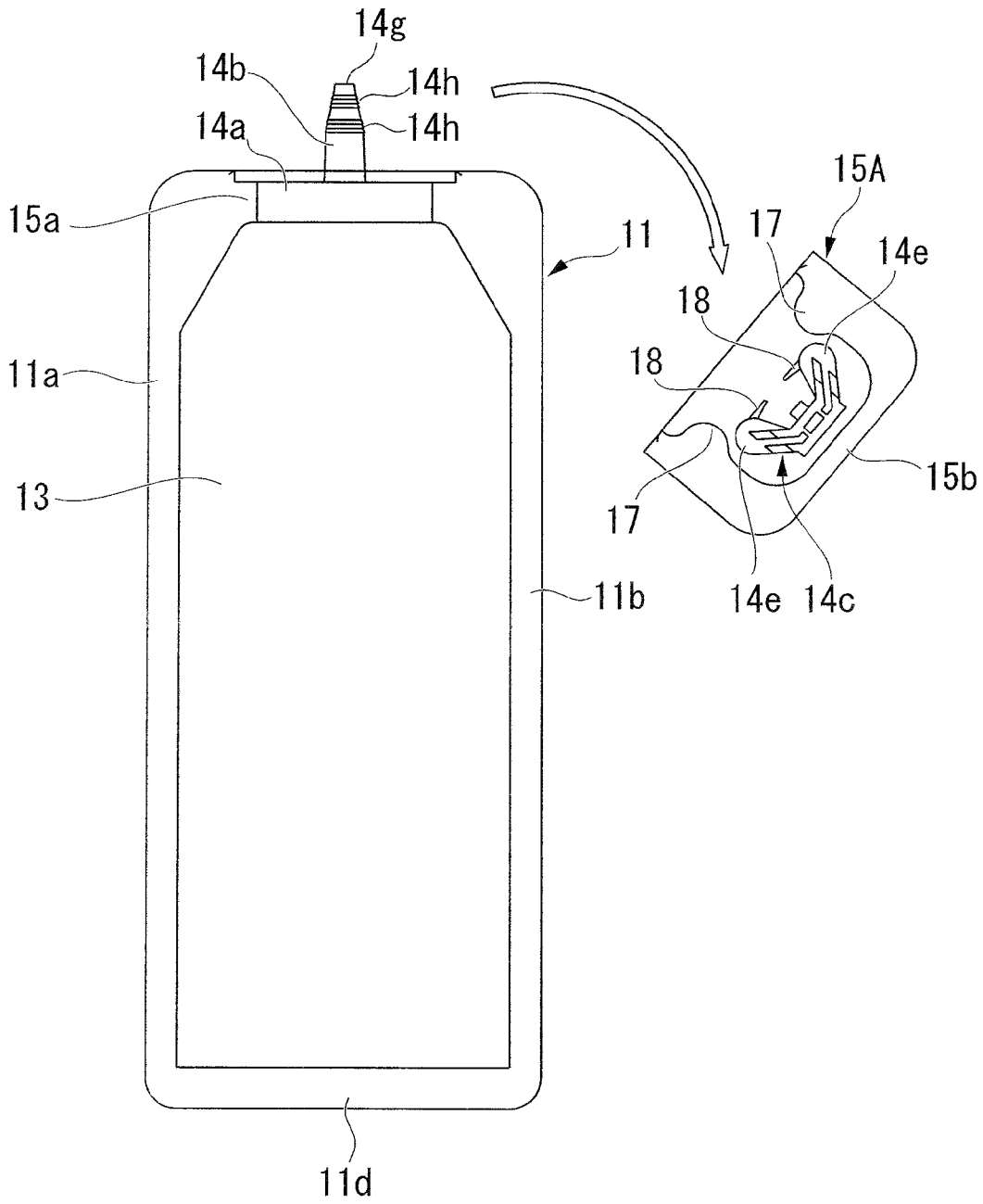
FIG. 10 is a front view showing a state where the package bag shown in FIG. 8 is opened.

As shown in FIGS. 3 and 4, a spout hole 14*f* which communicates with the accommodation chamber 13 is provided inside of the spout member 14. The spout hole 14*f* is required to be sealed when the package bag 10 is distributed with the accommodation chamber 13 filled with the contents. For this reason, the front end of the cylindrical portion 14*b* of the spout member 14 is sealed by the sealing portion 14*c*. In the sealing portion 14*c*, the thin portion 14*d* is formed in the circumferential direction of the front end of the cylindrical portion 14*b* of the spout member 14, and an opening 14*g* of the spout hole 14*f* is formed when the thin portion 14*d* is broken. In this case, the sealing portion 14*c* is a portion upper than the thin portion 14*d*, and is removed together with the opening assisting plate 14*e* when the spout member 14 is opened as shown in FIG. 5. In addition, as shown in FIGS. 8 and 9, in the case where the reinforcement connection piece 18 is provided, the reinforcement connection piece 18 and the cylindrical portion 14*b* are connected to each other through the thin portion 18*a*. When the spout member 14 is opened, as shown in FIG. 10, the sealing portion 14*c* is removed together with the opening assisting plate 14*e* and the reinforcement connection piece 18 by breaking the thin portion 18*a*.

The inner diameter of the front end of the cylindrical portion of the spout hole 14*f* is appropriately set in consideration of the viscosity or the like of the contents. The inner diameter which is 3 to 5 mm is suitable for the case where the viscosity of the contents is 100 to 10,000 mPa·s, and is more suitable for the case where the viscosity is 500 to 5,000 mPa·s.

When an annular convex portion 14*h* is formed in the outer peripheral surface of the cylindrical portion 14*b*, it is possible to prevent falling off of a tube in the case of the application in which the tube is connected to the cylindrical portion 14*b*.

In this example, the base portion 14*a* of the spout member 14 is formed in a shape (so-called boat shape) which is wide in the transverse direction along the first seal portion 15*a*, and is easily and reliably sealed to the inner surface of the body film 12.

As the spout member 14, for example, a member which is molded by a thermoplastic resin through injection molding may be used. As the thermoplastic resin, for example, polyolefin such as polyethylene or polypropylene may be mentioned. In addition, even in the case where the spout member 14 is molded by a material such as polyolefin having insufficient barrier properties, it is possible to ensure the barrier properties of the whole package bag by means of the combination with a packing material of the film 12 which has barrier properties.

The body film 12 includes an opening assisting line 16 at a portion formed as the sealing chamber 15. The opening assisting line 16 may be formed by a perforation or the like, but may be desirably formed by a half cut groove so as to prevent the inside of the sealing chamber 15 from communicating with the external air. In addition, when the body films 12 and 12 are torn along the opening assisting line 16, as shown in FIG. 5, a portion (hereinafter, referred to as "a spout member covering portion", and specifically a portion upper than the opening assisting line 16) 15A of the bag body 11 hiding the spout member 14 is removed, and the sealing chamber 15 is opened. The opening assisting plates 14*e* and 14*e* are disposed above the opening assisting line 16, and the sealing portion 14*c* of the spout member 14 is removed together with the spout member covering portion 15A upon opening the package bag.

Positions of both ends 16*a* of the opening assisting line 16 are located inside the second seal portion 15*b*. In this example, notches 16*b* are formed in both ends of the extended line of the opening assisting line 16. For example, the notches 16*b* may be formed by punching two sheets of the body film 12 and 12 in the thickness direction. Each of the ends 16*a* of the opening assisting line 16 is formed in a V-shape so that a torn line formed upon tearing from the notch 16*b* is connected to the opening assisting line 16. The notch 16*b* is formed as an I-shaped notch in the example shown in FIG. 2, but may be formed as a V-shaped notch or the like. The notch may be continuous to the opening assisting line. However, as in this example, if the notch is separated from the opening assisting line, for example, it is possible to prevent a problem in which the opening assisting line is unintentionally torn when an external force is applied to the notch during the transportation of the package bag.

In addition, the sandwiching reinforcement seal portions 17 and 17, each of which is formed by sealing the inner surfaces of two sheets of body films 12 and 12 to each other, are formed between the opening assisting plates 14*e* and the opening assisting line 16 so as to be located on the left and right sides of the spout member 14. The sandwiching reinforcement seal portions 17 and 17 are used to narrow a gap in the vicinity of the opening assisting plates 14*e* in the inside of the sealing chamber 15, and are formed to prevent the sealing portion 14*c* from falling off from the spout member covering portion 15A when the spout member covering portion 15A is separated from the bag body 11 upon opening the package bag (see FIG. 5). Here, in order to ensure that the opening assisting plates 14*e* are caught therein, as shown in FIG. 2, it is desirable that the gap d1 between the left and right sandwiching reinforcement seal portions 17 and 17 be shorter than the transverse width d2 of the opening assisting plates 14*e* and 14*e*.

In the case where the package bag 10 according to this example is opened, a part of the opening assisting line 16 is torn in a direction from one end of the sealing chamber 15, the sealing chamber 15 is partially opened along the first seal portion 15*a*, and then the opening assisting plate 14*e* is twisted so that the thin portion 14*d* of the front end of the cylindrical portion 14*b* is broken and the cylindrical portion 14*b* is opened in the state where the sealing portion 14*c* of the spout member 14 is sandwiched between two sheets of film 12 and 12. Subsequently, the remaining portions of two sheets of film 12 and 12 are torn along the opening assisting line 16 so as to separate the spout member covering portion 15A from the package bag body (a portion on the side of the accommodation chamber 13) corresponding to the remaining portion of the package body 11 in the state where the sealing portion 14*c* is sandwiched between two sheets of film. Accordingly, it is possible to open the opening assisting line 16 together with the cylindrical portion 14*b* of the spout member 14. When opening the package bag 10, it is possible to obtain the package bag 10, for example, in such a manner that the spout member covering portion 15A grabbed by one hand comes into contact with the accommodation chamber 13 of the bag body 11 while the first seal portion 15*a* is grabbed by the other hand.

Since the opening assisting plates 14*e* are caught by the sandwiching reinforcement seal portions 17 after opening the package bag 10, it is possible to prevent a problem that the sealing portion 14*c* of the spout member 14 is fallen off from the spout member covering portion 15A. For this reason, it is possible to promptly perform a series of operations of opening the package bag and opening the spout member. In addition, since it is possible to remove the sealing portion 14*c* by grabbing the opening assisting plates 14*e* through the spout member covering portion 15A of the bag body 11 without touching the spout member 14, the package bag is hygienic. Further, since the sealing portion 14*c* is not separated from the spout member covering portion 15A, it is easy to discard the trash in the state where its parts are not scattered.

It is desirable that the size of the spout member covering portion 15A is set to a degree (for example, several cm to several tens of cm) in which a finger tip is able to reach the end 16*a* of the opening assisting line 16 while the opening assisting plate 14*e* is held through the film 12, for example, in the inside of a palm when the film 12 is torn along the opening assisting line 16. In order to ensure the volume of the accommodation chamber 13 of the bag body 11, as shown in FIG. 1, the width (the transverse dimension in FIG. 1) of the spout member covering portion 15A may be set to be smaller than that of the accommodation chamber 13.

For example, in the case where the contents are transluminal enteral nutrients or transluminal enteral liquid foods, after the package bag 10 is opened, the cylindrical portion 14*b* of the spout member 14 is used as a spout in the state where the sealing portion 14*c* is removed as shown in FIGS. 5 and 10, and the contents may be spouted to the outside by connecting a tube (not shown) or the like to the spout. In addition, since the outer surface of the cylindrical portion 14*b* is provided with the annular convex portion 14*h* for locking the tube, it is possible to prevent falling off or deviation of the tube during the spouting operation. Further, in the cases of other products, it is possible to spout the contents to the outside through the opening 14*g* formed in the front end of the spout without connecting the tube or the like.

Figure 6:
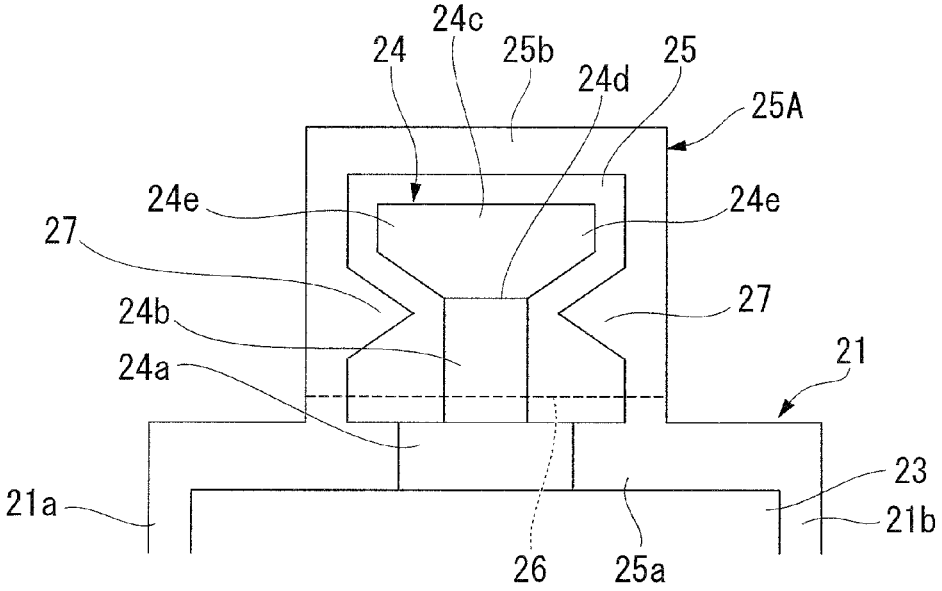
FIG. 6 is a schematic view showing a main part of another example of the package bag according to the present invention.
Figure 7:
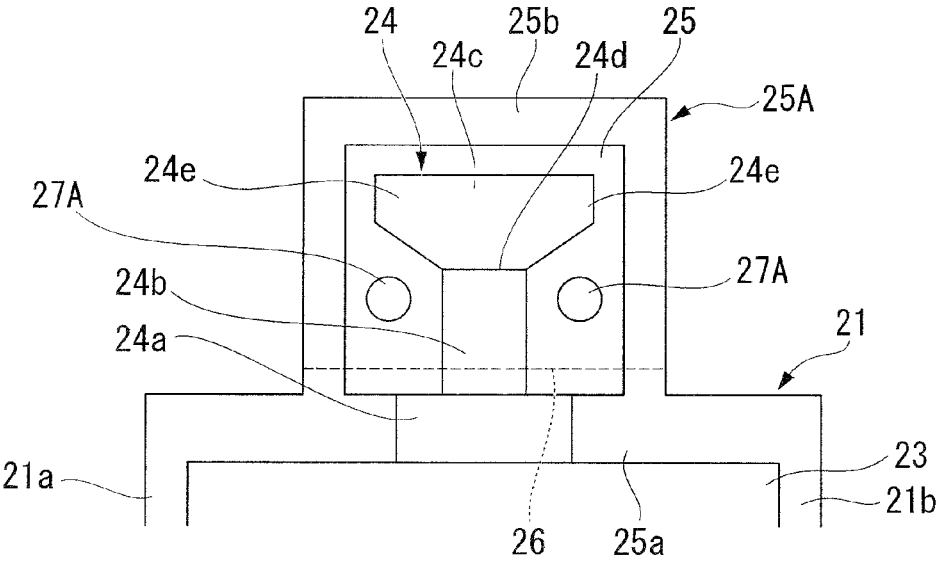
FIG. 7 is a schematic view showing a main part of still another example of the package bag according to the present invention.

While the preferred embodiment of the present invention is described and illustrated above, it should be understood that this is exemplary of the present invention and is not to be considered as limiting. FIGS. 6 and 7 schematically show a modified example of the present invention. In the example shown in FIG. 1, the opening assisting plates 14*e* and the sandwiching reinforcement seal portions 17 are formed in a circular shape, but as shown in FIG. 6, opening assisting plates 24*e* and sandwiching reinforcement seal portions 27 may be substantially formed in a polygonal shape when viewed from the front side thereof. Further, in the examples shown in FIGS. 1 and 6, the sandwiching reinforcement seal portions 17 and 27 are respectively formed in shapes connected to the second seal portions 15*b* and 25*b*. However, as shown in FIG. 7, sandwiching reinforcement seal portions 27A may be separated from second seal portions 25*b*.

The invention may be used to accommodate various products such as food, medicine, daily necessities, and industrial materials, and may be particularly used to accommodate contents, which are required to be desirably isolated from external contamination.

What is claimed is:

1. A package bag comprising:

two sheets of film which form a bag body; and a spout member which is formed between the two sheets of film, wherein the spout member includes a base portion which is fixed to the bag body, a cylindrical portion which protrudes upward from the base portion, and a sealing portion which seals a front end of the cylindrical portion through a breakable thin portion, the base portion is fixed to the two sheets of film through a first seal portion formed by sealing inner surfaces of the two sheets of film to an outer surface of the base portion, the cylindrical portion and the sealing portion are accommodated in a sealing chamber while being sandwiched between the two sheets of film, the sealing chamber is surrounded by the first seal portion and a second seal portion formed by sealing the inner surfaces of the two sheets of film to each other in the vicinity of the cylindrical portion and the sealing portion, the sealing chamber is opened by tearing the two sheets of film along an opening assisting line having both ends located inside the second seal portion and opened along the first seal portion, and an opening assisting plate protruding to at least one of a left side and a right side of the sealing portion is provided above the opening assisting line, and sandwiching reinforcement seal portions for reinforcing the two sheets of film by sealing the inner surfaces thereof are provided between the opening assisting plate and the opening assisting line, the sandwiching reinforcement seal portions being provided above the opening assisting line so as not to overlap the opening assisting line, the opening assisting plates protruding to both left and right sides of the sealing portion are provided above the opening assisting line, the sandwiching reinforcement seal portions formed in left and right sides of the spout member are provided between the opening assisting plates and the opening assisting line, and a gap between the left and right sandwiching reinforcement seal portions is shorter than a transverse width of the opening assisting plates.

2. The package bag according to claim 1, wherein a part of the sealing chamber is opened along the first seal portion, the opening assisting plates are twisted so as to break the thin portion and to open the cylindrical portion in the state where the sealing portion is sandwiched between the two sheets of film, and then a remaining portion of the two sheets of film is torn so as to separate a spout member covering portion covering the spout member together with the sealing portion from the bag body in the state where the sealing portion is sandwiched between the two sheets of film.

3. The package bag according to claim 1, wherein a part of the sealing chamber is opened along the first seal portion, the opening assisting plates are twisted so as to break the thin portion and to open the cylindrical portion in the state where the sealing portion is sandwiched between the two sheets of film, and then a remaining portion of the two sheets of film is torn so as to separate a spout member covering portion covering the spout member together with the sealing portion from the bag body in the state where the sealing portion is sandwiched between the two sheets of film.

* * * * *